US005544500A

United States Patent [19]

Speich

[11] Patent Number: 5,544,500

[45] Date of Patent: Aug. 13, 1996

[54] GUIDE BAR ARRANGEMENT FOR A CROCHET GALLOON KNITTING MACHINE

[75] Inventor: Francisco Speich, Gipf-Oberfrick, Switzerland

[73] Assignee: Textilma AG, Hergiswil, Switzerland

[21] Appl. No.: 347,457

[22] PCT Filed: Jan. 27, 1994

[86] PCT No.: PCT/CH94/00010

§ 371 Date: Dec. 5, 1994

§ 102(e) Date: Dec. 5, 1994

[87] PCT Pub. No.: WO94/23106

PCT Pub. Date: Oct. 13, 1994

[30] Foreign Application Priority Data

Apr. 7, 1993 [CH] Switzerland ..... 1062/93

[51] Int. Cl.[6] ..... D04B 27/26

[52] U.S. Cl. ..... 66/85 R; 66/207

[58] Field of Search ..... 66/85 R, 204, 66/207, 214

[56] References Cited

U.S. PATENT DOCUMENTS 3,303,670 2/1967 Bassist ..... 66/207

*Primary Examiner*—John J. Calvert

*Attorney, Agent, or Firm*—Anderson Kill Olick & Oshinsky, P.C.

[57] ABSTRACT

Guide bars (24, 32, 34) with thread guides (26, 36, 38) are arranged above the knitting needles (4). At least one group (G1 to G7) of at least two guide bars (36, 38) which are arranged one above the other is provided to increase the number of possible guide bars and/or to improve the accessibility of the guide bar region. This arrangement is effected in such a way that the thread guides of the guide bars (32, 34) arranged one above the other do not intersect.

5 Claims, 2 Drawing Sheets

GUIDE BAR ARRANGEMENT FOR A CROCHET GALLOON KNITTING MACHINE

BACKGROUND OF THE INVENTION

The invention is directed to a knitting machine, in particular a crochet galloon machine having a plurality of knitting needles and a plurality of thread guides associated with the knitting needles and supported on a driveable guide bars.

There are a great many known knitting machines or crochet galloon machines of the type mentioned above, e.g., see DE-A-30 34 253. A problem occurring in these knitting machines consists in that the area above the knitting needles is relatively confined so that only a limited number of guide bars and corresponding thread guides can be arranged. Accordingly, the pattern possibilities in such a knitting machine are also limited.

The object of the present invention is to improve a knitting machine, in particular a crochet galloon machine, of the type mentioned above.

SUMMARY OF THE INVENTION

This object of the invention is achieved by providing a knitting machine in which the number of guide bars and corresponding thread guides which can be provided within the available space is increased in that there is at least one group of at least two guide bars which are arranged one on top of the other. This results in the decisive advantage that either the accessibility of the guide bars is improved given the same number of guide bars or a substantially greater number of guide bars can be provided within the same space. When the guide bars are arranged one above the other in groups of two, the number of guide bars and accordingly the number of possible patterns is doubled. If the groups are formed by three guide bars arranged one above the other, the number of guide bars is tripled.

As was mentioned above, the advantages of the invention are provided even if only some of the guide bars are combined in groups of guide bars arranged one above the other. However, combining a a majority of the guide bars in groups of guide bars arranged one above the other is especially advantageous.

In principle, it is possible for the thread guides of a group of guide bars to act on different offset lines or racking lines. Associating the guide bars of a group with the arms offset line is more advantageous in that adjustment work is substantially facilitated.

Advantageously, the guide bars of a group contact each other and, preferably, are guided reciprocally. The reciprocal guiding of the guide bars of a group results in an optimal and precise guidance of the guide bars and thread guides. Bending of the guide bars is reduced to a minimum by the reciprocal support. Accordingly, high knitting speeds of up to 2000 rpm can be achieved. The reciprocal guidance of the guide bars also obviates the need to secure the guide bars against relative rotation resulting in a simpler and accordingly more economical construction. The stability of the arrangement and its accessibility are further improved by forming the guide bars as upright guide bars having substantially flat profile. Although, there are a number of different possible constructions for the reciprocal guidance of the guide bars, the construction, in which one of the guide bar is provided with a web lying in the main plane of the guide bars and the other guide bar has a complimentary groove, is particularly advantageous.

There is also a variety of possible constructions and arrangements of the thread guides. For instance, the thread guides of the lower guide bar of one group can be attached from the bottom and the thread guides of the upper guide bar can be attached from the top. However, attaching the thread guides of both the lower and upper guide bars from the top is more advantageous, since all thread guides are accessible from the top in this case and access to the thread guides for adjustment and/or for the purpose of repairing the thread is made possible in the simplest manner and without restricting space.

The feeding of the yams or threads to the thread guides is substantially improved by a further development of the knitting machine according to the thread guides are formed as a clip having a head portion with a guide eyelet for the thread. This has considerable importance particularly when the quantity of guide bars and thread guides is especially large.

BRIEF DESCRIPTION OF THE DRAWINGS

In the following, embodiment examples of the invention are described more fully with reference to the drawings.

DETAILED DESCRIPTION OF THE PREFERRED EMBODIMENTS

Figures 1, 2:
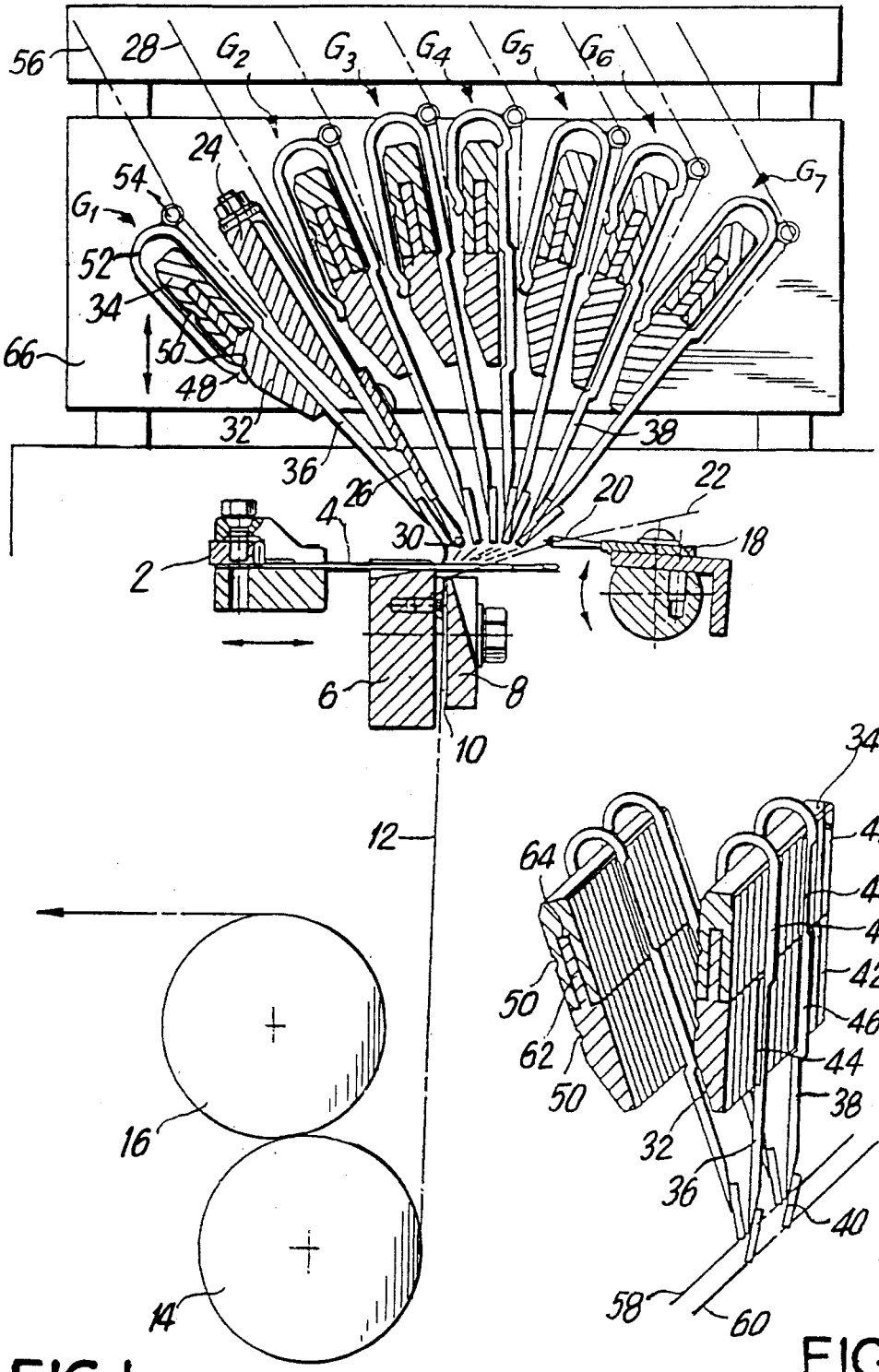
FIG. 1 shows the knitting location of a knitting machine in cross section.
FIG. 2 shows two groups of guide bars with thread guides in section.

FIG. 1 shows the knitting location of a knitting machine, in particular a crochet galloon machine. Knitting needles 4 which are guided in traversing or reciprocating motion at a knockover bar 6 are fastened to a knitting needle bar 2 which is guided in reciprocating motion. A guide rail 8 is supported in front of the knockover bar 6 and, together with the latter, forms a guide gap 10 through which the knitted fabric 12 is guided to take-off rollers 14, 16. Warp guide needles 20 which carry out a swiveling movement about the knitting needles and insert warp threads 22 into the respective knitting needles 4 are arranged in front of the knitting needles 4 at a warp guide bar 18.

An individual guide bar 24 with a thread guide 26 which feeds a thread 28, e.g., an elastic thread or rubber thread, to the knitting needles 4 via a guide needle or eye needle 30 of the thread guide 26 is arranged above the knitting needles 4. Thread guides 36 and 38 with tube needles 40 are fastened to groups $G_1$ to $G_7$ of guide bars 32, 34 which are arranged one above the other in pairs. The thread guides 36 and 38 are designed as clips which can be attached from above and cooperate with either the upper guide bar or lower guide bar 32, 34. For this purpose, each thread guide 36, 38 has a locking part 44 engaging in lock recesses 42 of the guide bar 32, 34 and a bridge part 46 which bridges the other respective guide bar. Every thread guide 36, 38 has a catch projection 48 at its back by means of which it engages in a locking groove 50 in the guide bar 32, 34 so as to prevent unwanted detaching of the thread guide. The head part 52 of the thread guides 36, 38 also contains a guide 54 in the form of a guide eye to guide the fed thread 56. As will be seen particularly from FIG. 2, thread guides 36 are connected with the lower guide bar 32 and thread guides 38 are connected with the upper guide bar 34, the thread guides of a group $G_1$ and $G_2$, respectively, being guided along an offset line or racking line 58, 60 in each instance.

The guide bars 32, 34 of each group $G_1$ to $G_7$ have a flat construction and are supported by one another. To this end, the lower guide bar 32 contains a cross-piece or web 62 which projects upward in the principle plane of the guide bar and engages in a corresponding groove 64 of the adjacent guide bar 34. The guide bars which move back and forth in their longitudinal direction are supported at their respective ends in a bearing block 66 in order to place the thread 28, 56 in the form of a filling yarn over at least one knitting needle by means of their reciprocating motion. Further, the bearing block 66 executes an up-and-down movement in order to move the thread guides from a position located above the knitting needles 4 into a position below the knitting needles.

The guide bars 24, 32, 34 are driven in a conventional manner, e.g., analogous to the embodiment example in DE-A-30 34 253 which was already cited above.

Figure 3:
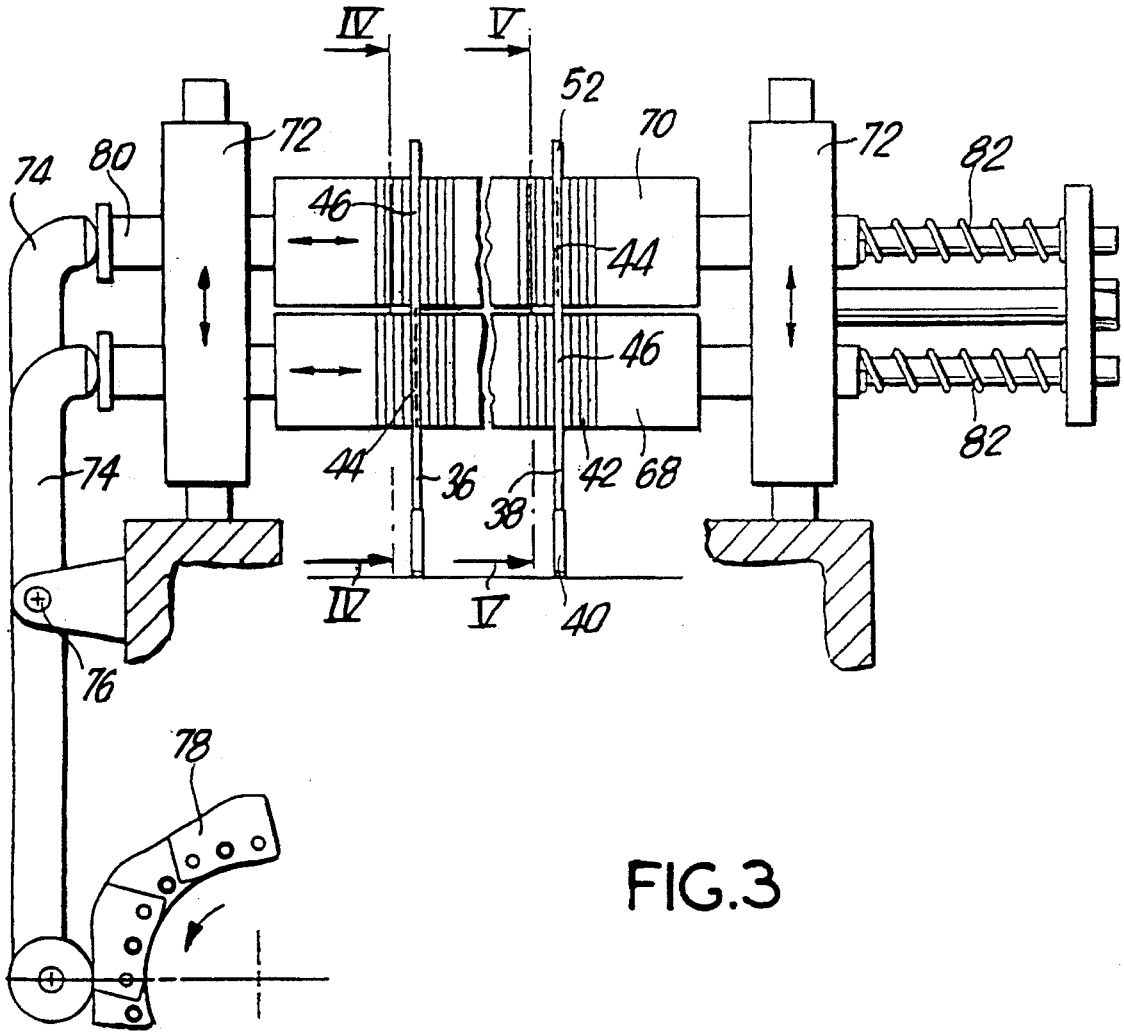
FIG. 3 shows another knitting machine in section and in a side view of the guide bars.
Figure 4:
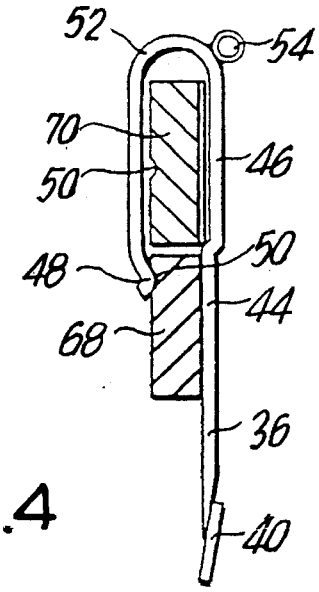
FIG. 4 shows the knitting machine of FIG. 3 in section along IV—IV of FIG. 3.
Figure 5:
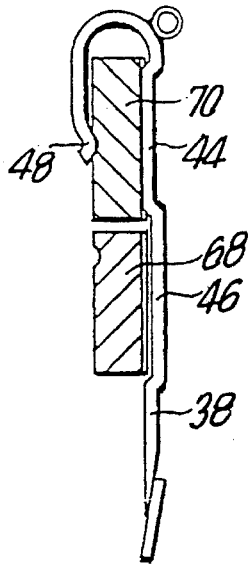
FIG. 5 shows the knitting machine of FIG. 3 in section along V—V of FIG. 3.

FIGS. 3 to 5 show another embodiment example of a knitting machine in section. In this case, the guide bars 68, 70 which are arranged in pairs are arranged one above the other but do not contact one another. As will be seen particularly from FIG. 3, the guide bars 68, 70 are again guided in bearing blocks 72 in their end region and are actuated at one side by rocker arms 74 which are swivelable about an axis 76 and are driven by a pattern chain 78. The rocker arms 74 cooperate with end pieces 80 of the guide bars 68, 70 which are tensioned against the rocker arms on the other side of the knitting machine by springs 82. The bearing blocks 72 are again guided and driven so as to move up and down in a manner which is not shown in more detail.

FIGS. 4 and 5 show the guide bars 68, 70 in cross section. FIG. 4 shows the lower thread guide 36 cooperating with the lower guide bar and FIG. 5 shows the upper thread guide 38 cooperating with the upper guide bar 70. Every thread guide contains a locking part 44 cooperating with locking recesses 42 of the associated guide bar 68, 70 and a bridge part 46 which bridges the respective guide bar 70 (FIG. 4) and 68 (FIG. 5) which is not contacted. Every thread guide 36, 38 contains a head part 52 and a rear locking projection 48 which engages in a corresponding locking groove 50 of the guide bar 68, 70. A guide 54 with a guide eye is provided at the head part 52 of the thread guide 36, 38.

With regard to the embodiment examples shown in the drawings it should be added that only some of the guide bars may be arranged in groups if desired. Moreover, the guide bars may be arranged one above the other not only in pairs, but also in groups of three or, in any case, in groups of four guide bars.

I claim:

1. A knitting machine, comprising:

a plurality of knitting needles; and at least one guide bar group associated with the plurality of knitting needles and comprising at least two upright guide bars equipped, respectively, with thread guides and arranged one above another;

wherein the guide bars have a substantially flat profile, wherein one of the two guide bars has a web lying in a main plane of the two arranged one above another guide bars, and another of the two guide bars has a complementary groove for receiving the web of the one guide bar, and wherein, the thread guides of the arranged one above another guide bars do not intersect and have each a profile such that the thread guide can be placed on a respective guide bar only from a top of the respective guide bar and overlaps another guide bar without contacting the another guide bar.

2. A knitting machine according to claim 1, further comprising several additional guide bar groups, wherein at least a majority of guide bar groups have guide bars thereof arranged one above another.

3. A knitting machine according to claim 1, wherein the thread guides are associated with same offset line.

4. A knitting machine according to claim 1, wherein the guide bar is formed as a clip having a head portion which includes a guide for a thread.

5. A knitting machine according to claim 4, wherein the guide for a thread is formed as a guide eyelet.

* * * * *

UNITED STATES PATENT AND TRADEMARK OFFICE

CERTIFICATE OF CORRECTION

PATENT NO. : 5,544,500

DATED : August 13, 1996

INVENTOR(S) : Francisco Speich

It is certified that error appears in the above-identified patent and that said Letters Patent is hereby corrected as shown below:

On the title page, item [86] should read --[86] PCT No: PCT/CH94/00018--

Signed and Sealed this

Twelfth Day of November, 1996

*Attest:*

Bruce Lehman

BRUCE LEHMAN

*Attesting Officer*

*Commissioner of Patents and Trademarks*